US006725576B2

(12) United States Patent
Emerson et al.

(10) Patent No.: US 6,725,576 B2
(45) Date of Patent: Apr. 27, 2004

(54) SNOWSHOE WITH MOLDED TAIL PIECE

(75) Inventors: Daniel T. Emerson, Berkeley, CA (US); Nathan J. Messmer, San Francisco, CA (US)

(73) Assignee: Atlas Snowshoe Company, San Francisco, CA (US)

( * ) Notice: Subject to any disclaimer, the term of this patent is extended or adjusted under 35 U.S.C. 154(b) by 0 days.

(21) Appl. No.: 10/039,169

(22) Filed: Jan. 4, 2002

(65) Prior Publication Data

US 2003/0126767 A1 Jul. 10, 2003

(51) Int. Cl.[7] ..... A43B 5/04
(52) U.S. Cl. ..... 36/122; 36/123
(58) Field of Search ..... 36/122, 123, 124, 36/125

(56) References Cited

U.S. PATENT DOCUMENTS 3,636,643 A * 1/1972 Lundquist ..... 36/123
4,203,236 A * 5/1980 Erickson et al. ..... 36/123
5,309,652 A * 5/1994 Campbell ..... 36/124
5,440,827 A 8/1995 Klebahn et al.
5,687,491 A 11/1997 Klebahn
5,699,630 A 12/1997 Klebahn et al.
5,918,387 A 7/1999 Emerson
6,006,453 A * 12/1999 Klebahn et al. ..... 36/123
6,105,281 A * 8/2000 Wing et al. ..... 36/122
6,233,849 B1 * 5/2001 Gallay et al. ..... 36/122
6,256,908 B1 7/2001 Warner

* cited by examiner

*Primary Examiner*—M. D. Patterson
(74) *Attorney, Agent, or Firm*—Thomas M. Freiburger

(57) ABSTRACT

A snowshoe having a tubular frame supporting a flexible deck has a molded tail piece connecting the tail ends of the tubular frame. The tail piece has two dowel members which are angled to form a rear apex, such that the tail ends of the tubular frame extend over the dowel members for secure connection. In addition, the molded tail piece has a connecting bracket extending forwardly, with a wide slot in which the tail of the stretched membrane decking is secured. In this way a rear support and connection point for the decking is provided by the tube end connector, while also providing tension on the tail piece retaining it in place without the need for fasteners.

9 Claims, 2 Drawing Sheets

SNOWSHOE WITH MOLDED TAIL PIECE

BACKGROUND OF THE INVENTION

This invention concerns snowshoes, and relates to the structure and manufacture of tubular frame type snowshoes having a stretched deck membrane.

Snowshoes of the general type of which this invention is concerned are shown in U.S. Pat. Nos. 5,440,827, 5,687,491, 5,699,630, 5,918,387, and 6,256,908. In those patents the snowshoes have a peripheral frame, preferably of an extended tube of metal such as aluminum, supporting a stretched deck membrane which may be of elastomeric material. This decking material typically is formed with a series of tabs or legs extending outwardly, which are wrapped around the peripheral frame and secured back to the decking, usually by riveting, with the decking stretched and taut. In the above patents the tail end of the snowshoe frame extends to a rear apex, which may be approximately a right angle or a more acute angle and the two tail ends of the tube are welded together. The deck membrane is fixed around the frame forward of and at either side of the rear frame apex.

Molded plastic tail pieces on tubular-frame snowshoes, for connecting the tubing tail ends in lieu of welding, have been known. Snowshoes of Yakima and Northern Lights have employed a molded element to connect the tube ends together at the tail. In one case a simple V-shaped molded element was employed, with cylindrical dowels extending into the frame. In the other case a tab additionally was provided extending forward, with an opening for the purpose of riveting the rear of the deck membrane to this molded element, directly through the tab opening.

U.S. Pat. No. 6,226,899 shows a snowshoe with a large molded plastic tail section, actually occupying perhaps 25% of the snowshoe's length as providing a part of the snowshoe's decking. Rails are received into that tail section.

SUMMARY OF THE INVENTION

A snowshoe having a tubular frame supporting a flexible deck has a molded tail piece connecting the tail ends of the tubular frame. The tail piece has two fingers or dowel members angled to form generally a V or U shape, such that the tail ends of the tubular frame fit in a sliding connection that secures the tubing ends in position over the dowel members. In addition, the molded tail piece has a connecting bracket extending forwardly, with a wide slot in which the tail of the stretched membrane decking is secured. In this way a rear support and connection point for the decking is provided by the tube end connector, while also providing tension on the tail piece retaining it in place without the need for fasteners.

Thus, in one embodiment a tail piece frees a snowshoe of the type formed of a peripheral tubular frame supporting a stretched deck membrane as a molded plastic body with a pair of fingers extending in angular relationship to one another, generally forming a V or U shape. The fingers are of a size to extend into the ends of the tubular frame. A tab is integrally formed with the fingers and extends generally in a forward direction between the fingers, and the tab, preferably flat in shape, has an elongated transverse slot positioned to receive a tail end of a snowshoe decking such that the decking tail end can pass through the slot and loop back forward relative to the snowshoe. In a prepared embodiment the molded plastic material comprises nylon with glass fiber filling.

It is therefore a principal object of the invention to provide a simple and efficient assembly for a tubular frame type snowshoe, and to provide a tail piece for this purpose. These and other objects, advantages and features of the invention will be apparent from the following description of preferred embodiments, considered along with the drawings.

DESCRIPTION OF PREFERRED EMBODIMENTS

Figure 1:
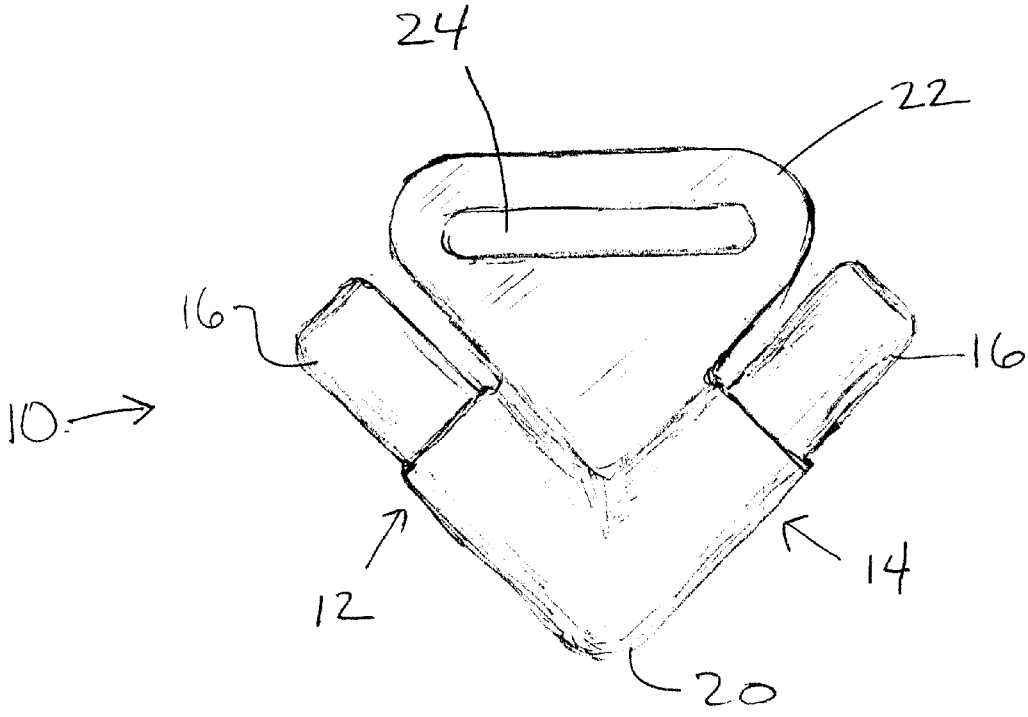
FIG. 1 shows a molded tail piece of the invention.

In the drawings, FIG. 1 shows a molded tail piece 10 for a snowshoe. The tail piece, which may be molded of a plastic material such as nylon with glass fiber filling, has a pair of fingers 12 and 14 at left and right, each with ends 16 which may be formed as hollow cylindrical dowels, for extending into the tail ends of a tubular snowshoe frame. Although a cylindrical shape is shown for the fingers or dowels, they could be in other shapes, such as oval, elliptical, square, etc. in cross section.

The two frame-connecting fingers 12 and 14 extend outwardly away from one another. The angle formed between the directions of the two fingers is preferably in the range of about 30° to 180°, to accommodate the angular relationship of the tail ends of a tubular snowshoe frame.

The two fingers 12, 14 of the molded snowshoe tail piece 10 in a preferred embodiment form an apex 20 at the rear, so as to form the rear of a snowshoe. The apex need not be relatively sharp, as shown, and could be rounded or even generally flat, and the term apex should be thus understood.

Extending in a forward direction in the integrally molded tail piece 10 is a tab 22, preferably flat in shape as shown. This provides a means of connection to the rear or tail portion of a flexible snowshoe decking. For this purpose the tab has an elongated slot 24 through which the tail end of the decking can pass and be looped back and fastened to itself.

Figure 2:
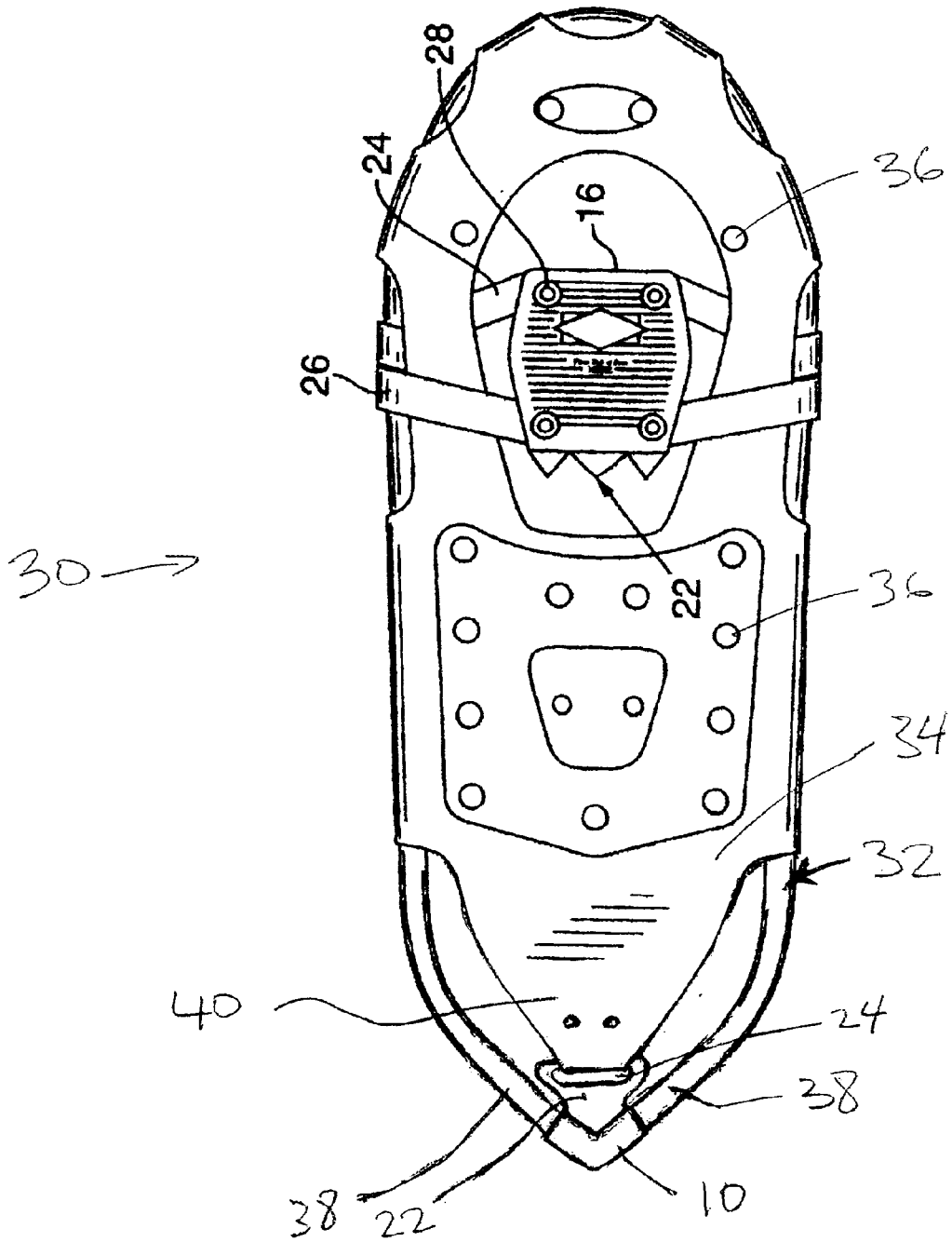
FIG. 2 shows the tail piece as installed on a snowshoe.

FIG. 2 shows a snowshoe 30 of the type with which this invention is concerned, i.e. with a tubular frame 32 on which a decking membrane 34 is tensioned, being wrapped around the tubing and fastened to itself as shown, as by rivets 36. The frame 32 has tubing ends generally at 38, and these receive the dowel ends 16 of the fingers 12 and 14 of the tail piece 10 shown in FIG. 1. As shown, the tab 22 is preferably shaped to extend alongside the tubing ends 38, providing the slot 24 for connecting to a tail end 40 of the decking membrane 34.

In one preferred form the tail piece 10 has fingers 12, 14 about 2 inches long, with reduced-diameter dowel ends 16 about ¾ inch, included in the 2-inch length. The length from the rear end to the front of the tab 22 may be about 2½ inches. The slot 24 may be about 1½ inches wide. These dimensions can vary considerably.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. A snowshoe with a flexible deck supported by a peripheral tubular frame, the tubular frame being bent and formed such that two rear ends of the frame converge toward one another and are closely adjacent to one another, the snowshoe including a molded plastic tail piece having two fingers arranged in generally a V shape, the fingers having end portions dimensioned to fit within rear ends of the tubular peripheral frame to thus retain the rear frame ends together, and the molded tail piece further including a forward-extending central tab having a transverse slot, the deck membrane of the snowshoe having a tail end which passes through the slot, looping back forward to a connection with the deck membrane to thus form a closed loop of material passing through the slot, with the deck membrane being in tension such that the tail piece is pulled in a forward direction relative to the snowshoe, retaining the fingers in the frame ends, and the tail piece having a width far smaller than a maximum width of the tubular frame.

2. A snowshoe according to claim 1, wherein each finger of the tail piece has a length of about two inches.

3. A snowshoe according to claim 1, wherein the two fingers form an angle of about 30° to 180°.

4. A snowshoe according to claim 3, wherein the two fingers of the tail piece form approximately a right angle.

5. A tail piece for use on a snowshoe of the type having a deck membrane supported under tension by a peripheral tubular frame, comprising:

a molded plastic body having a rear end and having a pair of fingers extending in an angular relationship to one another, generally forming a V or U shape, forming an angle between the fingers of about 30° to 180°, the fingers being capable of extending into the ends of a tubular frame, and a tab integrally formed with the fingers and extending in a forward direction, the tab having an elongated transverse slot for receiving a tail end of a snowshoe decking such that the decking tail end passes through the slot and loops back forward relative to the snowshoe.

6. A tail piece according to claim 5, wherein the molded plastic material comprises nylon with glass fiber filling.

7. A tail piece according to claim 5, wherein the molded plastic material comprises nylon.

8. A tail piece according to claim 5, wherein the fingers of the tail piece are about two inches long.

9. A tail piece according to claim 5, wherein the fingers form approximately a right angle.

* * * * *